United States Patent [19]

Bartholomew

[11] Patent Number: 4,541,535

[45] Date of Patent: Sep. 17, 1985

[54] SADDLE RACK

[76] Inventor: Richard P. Bartholomew, 2321 S. Santa Fe Ave., Vista, Calif. 92083

[21] Appl. No.: 471,777

[22] Filed: Mar. 3, 1983

[51] Int. Cl.[4] ..... A47F 5/08

[52] U.S. Cl. ..... 211/96; 211/13; 211/87

[58] Field of Search ..... 211/13, 86, 87, 96, 211/168, 163, 193; 248/145, 425, 289 R, 289 A

[56] References Cited

U.S. PATENT DOCUMENTS

| | | | |
|---|---|---|---|
| 496,173 | 4/1893 | Smith | 211/96 X |
| 928,659 | 7/1909 | Hunt | 211/163 |
| 2,595,521 | 5/1952 | Hanson | 211/86 |
| 2,760,746 | 8/1956 | Botdfsen | 211/13 X |
| 3,044,630 | 7/1962 | Szabo | 211/86 |
| 3,175,696 | 3/1965 | Milbourne | 211/86 |
| 3,315,819 | 4/1967 | Kingsberry | 211/163 |
| 3,512,654 | 5/1970 | Olsen et al. | 211/193 |
| 3,688,912 | 9/1972 | Wilmoth | 211/87 |

FOREIGN PATENT DOCUMENTS

| | | | |
|---|---|---|---|
| 1075207 | 4/1980 | Canada | 211/163 |

*Primary Examiner*—Robert W. Gibson, Jr.
*Attorney, Agent, or Firm*—Jack C. Munro; Jack C. Munro

[57] ABSTRACT

A saddle rack which includes a pair of side frame members which are attached to a supporting rod and extend outwardly therefrom in a downwardly dependent manner, resembling the wings of an airplane. A supporting rod is attached to a sleeve at a slightly upwardly extended angle. Extending through the sleeve is a first tubular member which is telescopingly mounted within an enlarged flange of a second tubular member. The sleeve is freely pivotable upon the first tubular member.

3 Claims, 5 Drawing Figures

SADDLE RACK

BACKGROUND OF THE INVENTION

The field of this invention relates to a structure for supporting a saddle spaced from a floor or ground and supporting the saddle in the correct manner to eliminate undesirable distortion of any portion of the saddle.

In the past, the common form of a saddle rack was a saw horse, the railing of a corral or any other similar convenient location. Also, it was common for saddles, even expensive saddles, to be merely thrown in a heap on the floor. Certain individuals have attempted to make some type of a saddle rack generally consisting of a two-by-four mounted in conjunction with a wall and extending outwardly therefrom. Using such improvised saddle racks, the saddle is not supported in a manner so that the saddle is kept in optimum shape. Also, in the use of a narrow two-by-four, a saddle very easily falls, which means that the saddle will end up on the floor or ground.

Frequently, there is a substantial mount of transporting involved with horses. This means that saddles must also be transported and therefore must be supported in some manner during transportation. The common mode of transporting is to merely throw the saddle in on the floor of the tack area of a trailer. If there is a saddle rack incorporated within the tack area of the trailer, it has been found that during the movement of the trailer during transportation, the saddle will frequently fall from this saddle rack.

Additionally, there is a wide variety of locations where saddle racks could be used, not only in tack rooms, but along side of a corral, within trailers, as well as many other locations. It is normally not feasible to install a permanent saddle rack in each location because it may be used only infrequently. Also, during times when the saddle rack is not being used at a particular location, it would be a hindrance to certain activities, such as normal horse training activities, or could possibly present a possible danger to both horses and individuals, in that a horse or the individual could incur injury by coming into contact with the saddle rack. It would therefore be desirable if the saddle rack could be constructed to be readily moved from one location to another and quickly installed for usage.

SUMMARY OF THE INVENTION

The saddle rack of the present invention is constructed of a vertically orientated tubular section which is composed of a first tube and a second tube, with the first tube being telescopingly located within an enlarged diametered end of the second tube forming a joint. The outer end of each tube is attached to a mounting plate. Each mounting plate is to be fixedly attached to a structure, such as a wall or is to be connectable with a separate bracket which has, in turn, been fixedly mounted to the wall. One of the tubular members extends through a sleeve, to which there is attached and protrudes therefrom, a supporting rod. The supporting rod is inclined at a slight angle upwardly with respect to horizontal. Extending in substantially opposite directions from the supporting rod are a pair of side frame members. Each of the side frame members are also inclined in a downwardly depending direction with respect to horizontal. The sleeve is pivotally mounted upon its tubular member so as to facilitate pivoting of the saddle to a specific orientation for desirable accessability in mounting of the saddle on the saddle rack or the removing of the saddle from the saddle rack.

The primary objectives of the present invention is to construct a saddle rack which is extremely strong and durable and will function maintenance free for a substantially long period of time.

Another objective of the present invention is to construct a saddle rack which can be utilized in conjunction with separate mounting brackets to allow for a multi-location installation of the same saddle rack.

Another objective of the present invention is to construct a saddle rack which supports the saddle in the most desirable manner so as to eliminate any possible distortion of the skirt of the saddle, or other portions of the saddle.

Still another objective of the present invention is to construct a saddle rack which can be readily utilized in a mobile environment in which the saddle will remain in place without being specifically tied down during normal operation of the mobile equipment.

Another objective of this invention is to construct a saddle rack which can be pivoted to any desirable location which therefore facilitates usage of the rack within a confined quarters area.

DETAILED DESCRIPTION OF THE SHOWN EMBODIMENT

Figure 1:
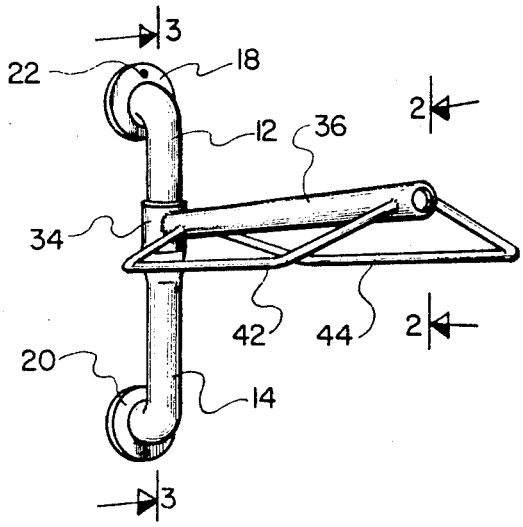
FIG. 1 is an isometric view of the saddle rack of the present invention showing two separate saddle racks mounted on a single vertical supporting span.
Figure 2:
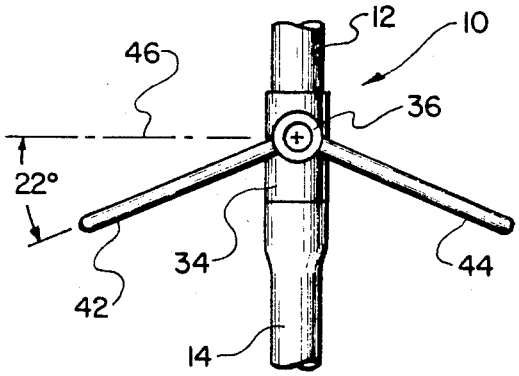
FIG. 2 is a cross-sectional view taken along line 2—2 of FIG. 1 which comprises an end view of the saddle rack of the present invention.
Figure 3:
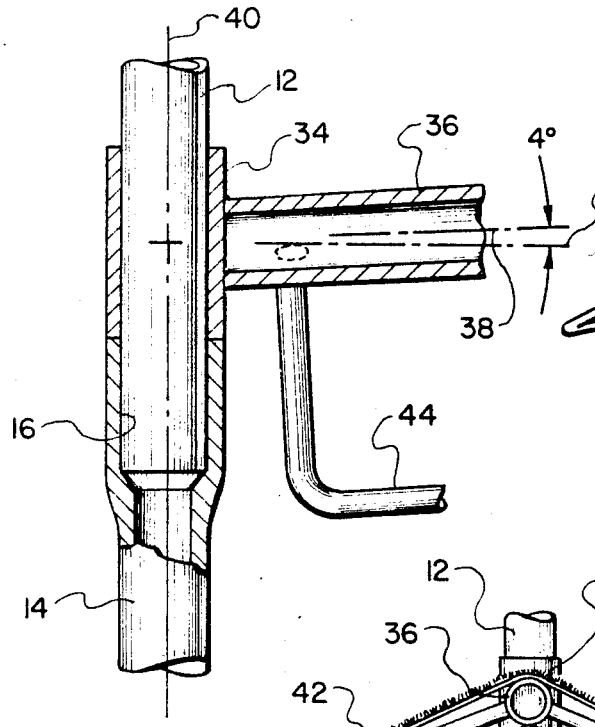
FIG. 3 is a cross-sectional view taken along line 3—3 of FIG. 1 showing the mounting arrangement of the saddle rack to a wall.
Figure 4:
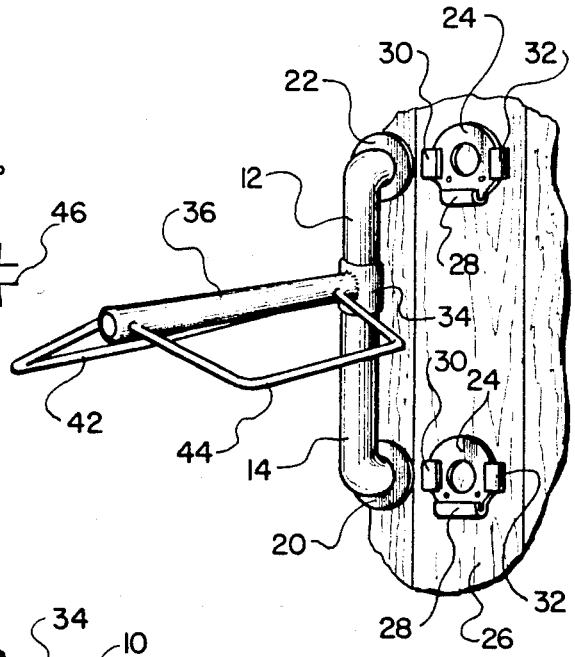
FIG. 4 is a segmental, isometric view of the bracket assembly utilized in conjunction with the saddle rack of the present invention to achieve multi-location usage of the saddle rack.

Referring particularly to the drawing, there is shown the saddle rack 10 of this invention in which there is utilized a vertically located span composed of a first tubular member 12 and a second tubular member 14. Each of the members 12 and 14 are cylindrical in cross-sectional configuration.

The inner end of the member 14 is enlarged to form socket 16. The inner end of the member 12 is to be locatable in a close fitting manner within the socket 16. The outer end of the member 12 is attached to a disc shaped mounting plate 18. A similar mounting plate 20 is attached to the outer free end of the member 14.

Within the plates 18 and 20, there may be located fastener openings 22 to facilitate the direct attachment of each of the members 12 and 14 to a wall 26 through the use of conventional fasteners extending through the openings 20 and then attaching to the wall 26.

However, instead of direct attachment through the use of openings 22, each disc 18 and 20 could connect with a bracket 24 which has been mounted instead on the surface of wall 26. Each of the brackets 24 are deemed to be identical and are constructed to have protruding L-shaped bottom lips 28 and protruding L-shaped side lips 30 and 32. Each of the discs 20 and 22 are to slidingly engage with their respective brackets 24, with each of the discs 20 and 22 then being restrained laterally between the side lips 30 and 32 and also being restrained in a downward direction by the bottom lip 28. Disengagement of the vertical span from the brackets 24 is by movement of such in the upward direction.

It is to be understood that, for the purposes of this invention, that upward is to be defined as opposite the direction of gravity, while downward would be in the direction of gravity, or toward the floor or ground. Horizontal is to be defined as being perpendicularly transverse to the direction of gravity.

The first tubular member 12 extends through a sleeve 34, with the lower end of the sleeve 34 being in contact with the upper edge of socket 16. The sleeve 34 is freely pivotable on the member 12. However, because of interference of the wall 26 on which the vertical span is mounted, the pivoting movement of the sleeve 34 will be limited to approximately one hundred and eighty degrees.

When a saddle is not located on the rack 10, the sleeve 34 is freely pivotable. When a saddle is located on rack 10, the lowermost front edge (nearest rod 36) "bites" into the member 12 tending to hold the rack 10 fixed and not freely pivotable. Also, the rearward upper edge (farthest away from rod 36) of sleeve 34 also similarly "bites" into rod 12. This is desirable to retard this pivoting movement when a saddle is located on rack 10.

Fixedly secured and extending from the sleeve 34 is a supporting rod 36. This supporting rod 36 will normally be constructed of a metal material similar to the metal utilized in the members 12 and 14. The supporting rod 36 has a longitudinal center axis 38. The vertical span composed of members 12 and 14 has a longitudinal center axis 40. The supporting rod 36 is attached to the sleeve 34 so that the longitudinal center axis 38 is inclined upwardly at approximately four degrees. The reason for this will be explained further on in the specification.

Secured to the supporting rod 36 are a pair of side frame members 42 and 44. Each of the side frame members 42 and 44 are composed of a small diametered rod which is formed into a substantially U-shape and is secured as by welding or other positive securement means to the supporting rod 36. Each of the side frame members 42 and 44 are substantially identical in construction and are mounted on the rod 36 in a mirror image relationship with respect to the vertical axis through the supporting rod 36.

Each of the side frame members 42 and 44 form a planar surface. This planar surface is located at an inclined angle with respect to the horizontal 46. The most desirable angle is approximately twenty two degrees.

The undersurface of the skirt of a saddle (not shown) is to be located on each of the side frame members 42 and 44 and across supporting rod 36. In most instances, the skirt will rest against the side frame members 42 and 44, but will be spaced just slightly above the supporting rod 36. This will mean that the points of support for the saddle are laterally spaced-apart, which is most desirable to achieve a positive base of support.

Also, as previously mentioned, the saddle rack 10 of this invention can be utilized within a mobile environment, such as a horse trailer, where the saddle may incur a small continuous jostling movement during transporting of the trailer. Because the supporting rod 36 is inclined at approximately four degrees, this jostling movement will tend to maintain the saddle on the saddle rack 10 and against the vertical span defined by members 12 and 14. If the longitudinal center axis 38 coincided with the horizontal 46, due to the weight of the saddle on the saddle rack 10, the saddle would be located in a slight downwardly depending direction. Therefore, continuous jostling movement would tend to move the saddle toward the outer free end of the supporting rod 36 and eventually the saddle would fall from the saddle rack 10.

Figure 5:
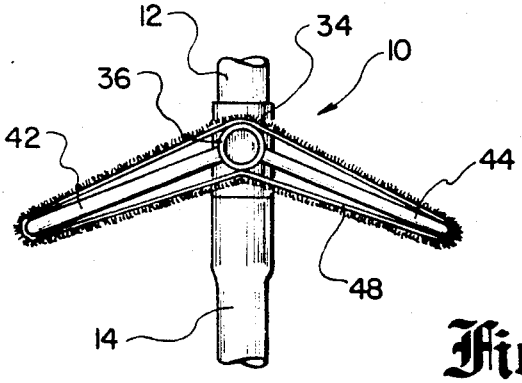
FIG. 5 is a view similar to FIG. 2 but showing the saddle rack covered with a padding.

It may be desirable to cover the saddle rack 10 with a resilient material, such as a carpet-like material 48. Such a carpet-like material 48 is shown in FIG. 5 located about the rod 36 and the side frame members 42 and 44 of the saddle rack 10.

What is claimed is:

1. A saddle rack comprising:

wall mounting means composed of first and second tubular members joined together in a telescoping arrangement forming a joint, said first and second telescoping members having a common first longitudinal center axis;

a frame having a sleeve, said first tubular member to extend through said sleeve, said sleeve to abut against said second tubular member at said joint, said sleeve being freely pivotable about said first tubular member;

said frame including a supporting rod, one end of said rod being attached to said sleeve and extending therefrom, said rod having a second longitudinal center axis, said supporting rod being mounted so said second longitudinal center axis is displaced from the perpendicular to said first longitudinal center axis, said displacement being so that the outer end of said frame is at a higher elevation than the connection of said supporting rod to said sleeve, whereby any jostling of a saddle supported by said supporting rod tends to maintain the saddle on said supporting rod;

a pair of side frame members attached to said supporting rod and extending therefrom substantially opposite to each other, each said side frame member forming a planar supporting surface, each said planar supporting surface being located at an acute angle to horizontal in a downwardly depending manner, whereby the undersurface of the skirt of a saddle is to be placed on said side frame members across said supporting rod to thereby be supportedly spaced from the floor; and said wall mounting means including wall mounting brackets, said first and second tubular members being removably connected to said wall mounting brackets thereby facilitating transfer of said saddle rack from one location to another location to then be engaged with a separate pair of said wall mounting brackets.

2. The saddle rack as defined in claim 1 wherein:

said sleeve having a biting edge, said biting edge being tightly pushed into the surface of said first tubular member when said saddle rack is in use thereby tending to maintain said saddle rack in an established position substantially preventing pivotal movement of said sleeve relative to said first tubular member.

3. The saddle rack as defined in claim 2 wherein:

said acute angle being approximately twenty two degrees, said displacement being approximately four degrees.

* * * * *